United States Patent [19]

Bush, et al.

[11] Patent Number: 4,850,819

[45] Date of Patent: Jul. 25, 1989

[54] MOTOR COMPRESSOR BEARING ASSEMBLY

[75] Inventors: James W. Bush; James F. Fogt, both of Sidney, Ohio

[73] Assignee: Copeland Corporation, Sidney, Ohio

[21] Appl. No.: 123,185

[22] Filed: Nov. 20, 1987

[51] Int. Cl.[4] ..... F04B 39/02

[52] U.S. Cl. ..... 417/368; 184/6.18

[58] Field of Search ..... 417/365, 366, 368; 418/203; 384/425, 426, 905.1; 184/6.16, 6.18

[56] References Cited

U.S. PATENT DOCUMENTS

| | | | |
|---|---|---|---|
| 2,500,751 | 3/1950 | Halfvarson | 184/6.18 X |
| 2,523,847 | 9/1950 | Russey | 384/425 |
| 2,963,113 | 12/1960 | Ayling | 184/6.18 |
| 4,131,396 | 12/1978 | Privon et al. | 184/6.18 X |

*Primary Examiner*—Leonard E. Smith
*Assistant Examiner*—Leonard P. Walnoha
*Attorney, Agent, or Firm*—Harness, Dickey & Pierce

[57] ABSTRACT

A pair of thrust washers support the lower end of a crankshaft for rotation in a bearing in a hermetic refrigerant motor compressor and also provide a combination of oil passages for supplying lubricating oil to a pump in a crankshaft and from the pump to the bearing.

13 Claims, 2 Drawing Sheets

MOTOR COMPRESSOR BEARING ASSEMBLY

This invention relates to vertical crankshaft motor compressors, such as hermetic scroll-type and reciprocating-piston-type compressors especially adapted for compressing refrigerant, and more particularly to an arrangement for assuring that proper lubricant is supplied to the compressor crankshaft lower bearing.

In compressor machinery of the present type it is common to have a crankshaft mounted vertically and journalled for rotation in bearings adjacent its opposite ends, oil being provided to the bearings through radical side passages connected to a vertical passage that extends eccentrically the length of the crankshaft, there being an oil sump in which the lower end of the crankshaft is immersed. It is important that such arrangements provide adequate lubrication at all times, and in machines of the type to which the present invention is suited the lower bearing assembly must provide the additional function of supporting the entire downward thrust of the crankshaft and motor rotor.

Accordingly, the primary object of this invention resides in the provision of an extremely simple arrangement for lubricating rotating vertical crankshafts and particularly the lower bearing journalling same, as well as for adapting the lower bearing assembly to also support the weight of the crankshaft and motor rotor with minimum wear. The present invention utilizes parts which are inexpensive to form and easy to assemble with little chance of mistake, and yet provide reliable lubrication and thrust support.

Additional advantages and features of the present invention will become apparent from the subsequent description and the appended claims taken in conjunction with the accompanying drawings.

DESCRIPTION OF THE PREFERRED EMBODIMENT

Figure 1:
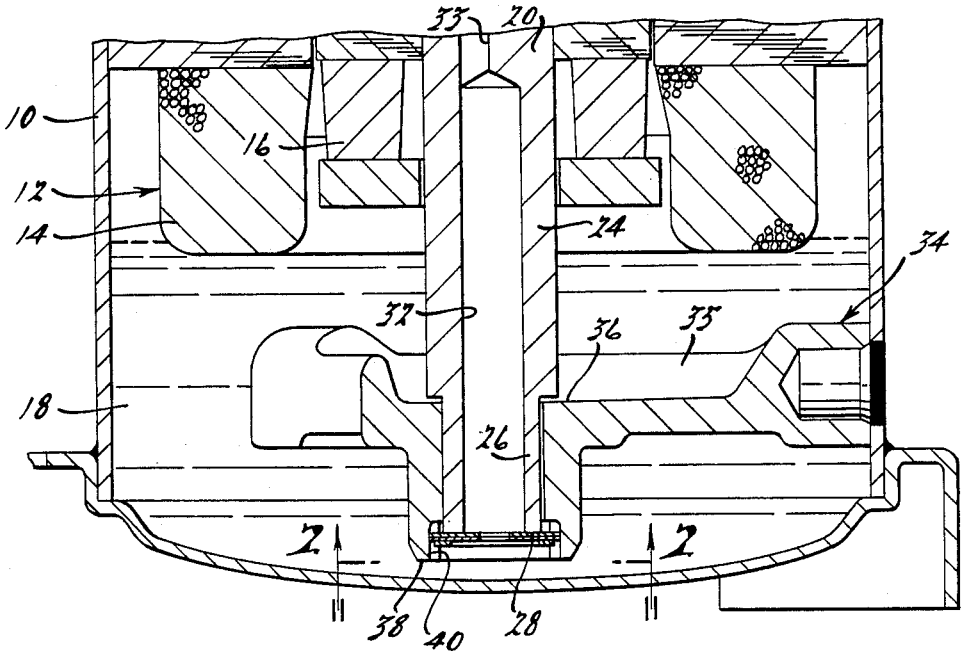
FIG. 1 is a side elevation view in section of the lower portion of a hermetic motor compressor showing the compressor crankshaft journalled at its lower end in a compressor bearing assembly embodying the principles of the present invention.
Figure 2:
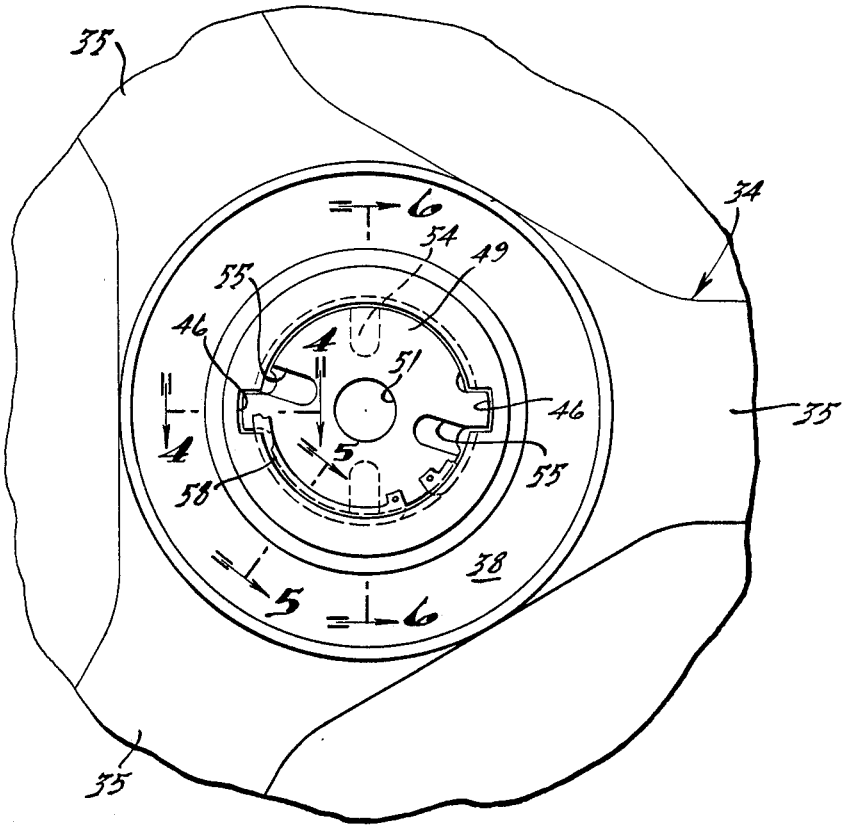
FIG. 2 is a bottom plan view of the bearing assembly taken along line 2—2 in FIG. 1.
Figure 3:
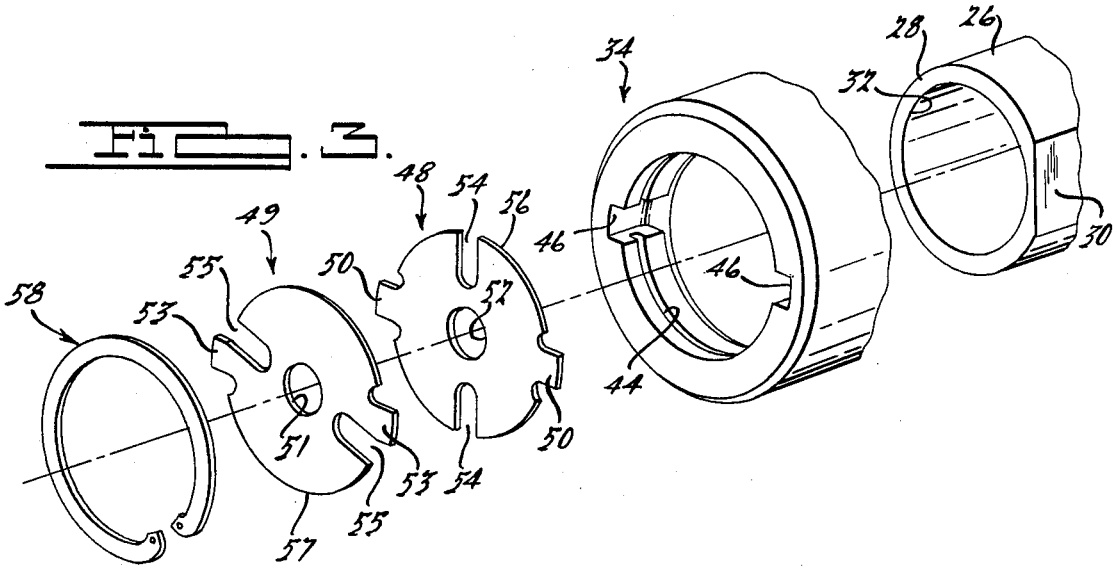
FIG. 3 is an exploded perspective view of the bearing assembly showing thrust washers in accord with the present invention.
Figure 4:
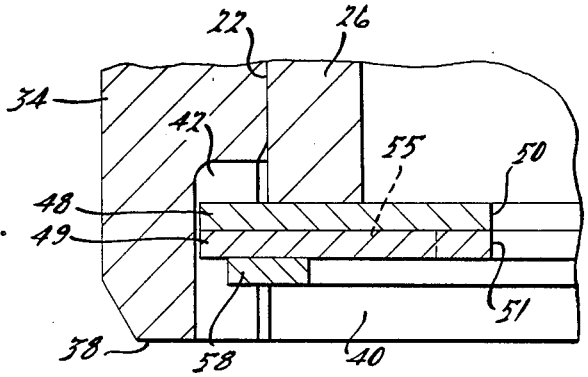
FIG. 4 is a section view of the bearing assembly taken along line 4—4 in FIG. 2.
Figure 5:
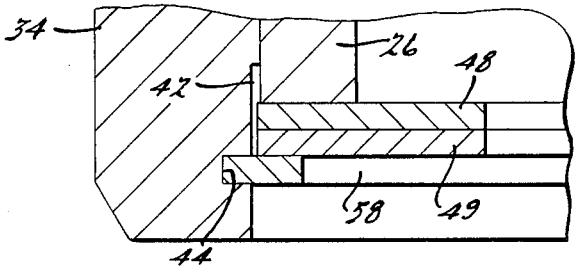
FIG. 5 is a section view of the bearing assembly taken along line 5—5 in FIG. 2.
Figure 6:
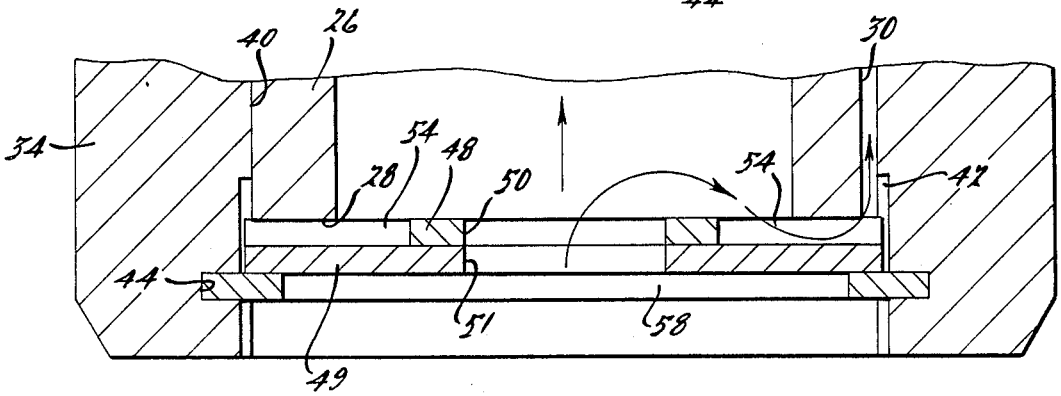
FIG. 6 is a section view taken along line 6—6 in FIG. 1 showing oil distribution through the bearing washers and crankshaft.

Although the principles of the present invention may be applied to many different types of compressors having a vertical crankshaft which is rotatably journalled at its lower end in a bearing disposed in an oil sump, for examplary purposes the discussion herein relates to a hermetic scroll-type machine which has specific utility in the compression of refrigerant for air conditioning and refrigeration applications, such as the one disclosed in assignee's copending application for patent Ser. No. 899,003, filed Aug. 22, 1986, the disclosure of which is expressly incorporated herein by reference.

The machine comprises an upper crankshaft bearing (not shown), a pair of mated spiral scroll members for compressing gases (not shown), a vertically disposed rotatable crankshaft 20, an electric motor 12 including a stator 14 and a motor rotor 16 heat shrunk on the outer periphery of the crankshaft, a lower bearing 34 in which is journalled the lower end of the crankshaft, and a shell 10 enclosing all of the above elements with the stator press fit within the shell. The compressor lower bearing 34 is rigidly secured by arms 35 to the shell and has a cylindrical bore 40 at its center extending between upper end lower faces 36 and 38 thereof which forms the bearing journal. The bottom of the shell, including the compressor lower bearing, constitutes a sump 18 filled with lubricating oil.

Crankshaft 20 is rotatably driven relative to its primary axis by the motor and includes an eccentric fluid passage 33 that extends the length of the crankshaft from a central pumping chamber 32 to supply fluid to the scroll assembly and upper bearing in the usual manner. The lower end of the crankshaft is stepped to define a reduced diameter bearing portion 26 including a generally planar end face 28 journalled in lower bearing 34. The outer periphery of crankshaft portion 26 is provided with an axial flat 30 on the unloaded side of the crankshaft to provide an oil path for the length of bearing 34.

In accord with this invention a pair of uniquely designed generally flat circular thrust washers 48 and 49 formed of hardened steel are adapted to be retained within an enlarged lower portion of bore 40 of lower bearing 34 by a snap ring 58 disposed within an annular groove 44 spaced inwardly from end face 38. A pair of diametrically opposed axial keyways 46 extend radially outwardly from the surface of bore 40 adjacent end face 38. Thrust washer 48 comprises a central opening 52, a pair of diametrically opposed alignment keys 50 each extending radially outwardly from its circumference 56 and a pair of generally U-shaped slots 54 each extending radially inwardly from circumference 56. Thrust washer 49 is similar to washer 48 and comprises a central opening 51, a pair of diametrically opposed alignment keys 53 each extending radially outwardly from circumference 57, and a pair of generally U-shaped slots 55 each extending radially inwardly from circumference 57. The keys 52 and 53 are adapted to register with keyways 46 when the washers are inserted into bore 40, where they are retained by retaining ring 58 in groove 44.

In the embodiment shown, washers 48 and 49 have substantially the same diameter and if superposed the respective keys 48 and 49 align or register with one another. However, the slots 54 and 55 are angularly spaced from their respective keys such that when the keys 48 and 49 are aligned slots 54 do not align or register with the slots 55. When the thrust washers 48 and 49 are mounted in bore 40 U-shaped slots 54 on thrust washer 48 therefore do not communicate with U-shaped slots 55 on thrust washer 49, although central openings 50 and 51 are always aligned with one another and with pump chamber 32 in the crankshaft. Lower end face 28 of the crankshaft is supported on the top surface of the upper thrust washer. The enlarged lower end portion of bore 40 is slightly defines a 360° annular oil cavity 42 encircling and extending above washers 48 and 49.

A significant feature of the invention is that the thrust washers provide the dual function of defining an oil path and taking the thrust load of the crankshaft. Oil is received from sump 18 axially upwardly through openings 51 and 52 into pump 32 from which it is centrifugally pumped radially outwardly through U-shaped slots 54 in the upwardmost thrust washer 48 to cavity 42 encircling the lower end of the crankshaft. Flat 30 is located on the unloaded side of the crankshaft so that as the crankshaft rotates oil is drawn up into the lower bearing journal from cavity 42, which is under a slightly positive pressure. By virtue of slots 54 and 55 being angularly offset with respect to the keys a user cannot misassemble the two washers in a manner such that oil does not get supplied to the cavity 42 to lubricate the lower crankshaft bearing. The washers can be inserted and/or swapped for one another and the arrangement will still work satisfactorily, so long as one is of the washer 48 configuration and the other is of the washer 49 configuration. Furthermore, they may be inexpensively fabricated by simply stamping them from sheet metal. Bearing 34 is also easy to fabricate because all machining operations can be performed from one side (i.e. the bottom side).

While it is apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A motor driven compressor comprising:

a motor;

a generally vertically extending crankshaft associated with said motor;

a bearing housing having a bearing journaling the lower end of said crankshaft;

an oil sump;

a lubrication pump in the lower end of said crankshaft; and thrust means disposed in the lower end of said bearing for supporting the vertical thrust loads generated by said crankshaft, said thrust means including means for placing oil in said sump in fluid communication with said pump, and means disposed in said thrust means for directing the output of said pump radially outwardly and into fluid communication with said bearing.

2. A compressor as claimed in claim 1, wherein said thrust means comprises a pair of generally flat washers.

3. A compressor as claimed in claim 3, wherein said washers are stacked on top of one another with each lying in a plane which is transverse to the rotational axis of said crankshaft.

4. A compressor as claimed in claim 2, wherein each of said washers has a central through-opening for communicating oil to said pump, a slot extending generally radially inwardly from the periphery thereof to a point spaced from said opening for communicating oil from said pump to said bearing, and keying means to prevent rotation of said washer in said bearing housing.

5. A compressor as claimed in claim 4, wherein said keying means comprises a key on said washer and a corresponding recess in said bearing housing.

6. A compressor as claimed in claim 4, wherein said recess receives a key on both of said washers.

7. A compressor as claimed in claim 4, wherein said slots are positioned so that when said washers are stacked with their respective keying means aligned the slot on one said washer will not communicate with the slot on the other said washer.

8. A compressor as claimed in claim 4, wherein each washer has a pair of diametrically opposed slots of generally similar configuration.

9. A compressor as claimed in claim 4, wherein said washers may be stacked in any order.

10. A compressor as claimed in claim 4, wherein said bearing housing has an annular oil supply cavity disposed in fluid communication with said washer slots.

11. A compressor as claimed in claim 10, wherein the portion of said crankshaft journaled in said bearing has a flat on one side thereof in fluid communication with said oil supply cavity.

12. A compressor as claimed in claim 4, wherein said washers are retained in place by a snap ring disposed in a groove in said bearing housing.

13. A compressor as claimed in claim 1, wherein said thrust means is disposed in said oil sump.

* * * * *